US006590325B1

(12) United States Patent
Park

(10) Patent No.: US 6,590,325 B1
(45) Date of Patent: Jul. 8, 2003

(54) STRUCTURE FOR PREVENTING HOWLING OF SHADOW MASK IN CATHODE RAY TUBE

(75) Inventor: Yoon San Park, Kyongeangbuk-do (KR)

(73) Assignee: LG Electronics, Inc., Seoul (KR)

( * ) Notice: Subject to any disclaimer, the term of this patent is extended or adjusted under 35 U.S.C. 154(b) by 156 days.

(21) Appl. No.: 09/592,554

(22) Filed: Jun. 12, 2000

(30) Foreign Application Priority Data

Jun. 11, 1999 (KR) ..... 99-21687

(51) Int. Cl.[7] ..... H01J 29/80
(52) U.S. Cl. ..... 313/402; 313/407; 313/461
(58) Field of Search ..... 313/402, 407, 313/408, 404, 461

(56) References Cited

U.S. PATENT DOCUMENTS 4,495,437 A * 1/1985 Kume et al. ..... 313/403
4,551,651 A * 11/1985 van der Ven ..... 313/402
4,933,595 A * 6/1990 Hens ..... 313/402
5,103,132 A * 4/1992 Van Der Bolt et al. ..... 313/402
5,289,080 A * 2/1994 Park ..... 313/402
5,557,162 A * 9/1996 Han ..... 313/402
5,644,192 A * 7/1997 Ragland, Jr. ..... 313/402
5,932,957 A * 8/1999 Ragland, Jr. ..... 313/402
6,025,676 A * 2/2000 Ohama et al. ..... 313/477 R
6,046,535 A * 4/2000 Jung ..... 313/402
6,104,132 A * 8/2000 Nose et al. ..... 313/402
6,218,772 B1 * 4/2001 Shimizu et al. ..... 313/402
6,225,735 B1 * 5/2001 Nakagawa et al. ..... 313/407
6,323,589 B1 * 11/2001 Inoue et al. ..... 313/402
6,333,594 B1 * 12/2001 Nakagawa et al. ..... 313/461

FOREIGN PATENT DOCUMENTS

JP 01095443 A * 4/1989
JP 08264114 A * 10/1996

* cited by examiner

*Primary Examiner*—Vip Patel
*Assistant Examiner*—Kevin Quarterman
(74) *Attorney, Agent, or Firm*—Birch, Stewart, Kolasch & Birch, LLP

(57) ABSTRACT

A structure for preventing howling of a shadow mask in a cathode ray tube. The tube includes a panel having a fluorescent material screen on an inside surface, a shadow mask for selecting a color of electron beams emitted from an electron gun, and frames each fastened to a long side of the shadow mask to support the shadow mask on the panel through connecting members for applying a tension to the shadow mask in a vertical direction. The shadow mask includes an effective surface having holes for selecting the color of the electron beams, non-effective surfaces which form no screen, and howling prevention members bent along short side edges of the non-effective surfaces in a horizontal front-to-back direction. This provides a high quality picture because howling is improved even at edge portions of the shadow mask owing to the enhanced moment of inertia and higher natural frequency of the edge portions of the shadow mask.

5 Claims, 6 Drawing Sheets

(A)

(B)

(A)

(B)

STRUCTURE FOR PREVENTING HOWLING OF SHADOW MASK IN CATHODE RAY TUBE

BACKGROUND OF THE INVENTION

1. Field of the Invention

The present invention relates to a structure of a shadow mask in a cathode ray tube for color picture tube and color monitor, and more particularly, to a structure for preventing howling of a shadow mask in a cathode ray tube, in which bent parts are extended in a horizontal front-to-back direction along short side edges of a non-effective surface of a shadow mask, to enhance a rigidity of an edge portion of the shadow mask, that increases a natural frequency, for improving howling characteristics of the edge portion of the shadow mask.

2. Background of the Related Art

In general, the cathode ray tube has howling caused by disturbances, such as external impacts, and sound waves, which make the shadow mask fastened to a main frame to vibrate so as to impede an exact focusing of electron beams onto respective pixels through holes in the shadow mask, that deteriorates a picture quality. In order to minimize the howling, though various methods are suggested, such as modifying a structure of the main frame, changing a material or structure of a spring which support the main frame, or the like, there is a limitation in elimination of the howling caused by the vibration of the shadow mask coupled with a vibration of the main frame to the root.

FIG. 1 illustrates a side section of a related art assembly of a panel and a shadow mask, and FIG. 2 illustrates a detailed perspective view of an outer appearance of the shadow mask in FIG. 1, showing the panel 1, the spring 2, the main frame 3, and the shadow mask 5 fitted in the cathode ray tube. The panel 1 has a fluorescent material screen on an inside surface thereof, and the shadow mask 5 selects a color from the electron beams emitted from an electron gun, and focuses onto respective pixels on the fluorescent material screen. To do this, the shadow mask 5 has an effective surface 7 having a plurality of holes 6 for focusing the electron beams onto respective pixels, and non-effective surfaces 8 on outer sides of the effective surface 7. Edge parts of long sides of the shadow mask 5 are fastened to the main frame 3. The shadow mask 5 is tightened from the main frame 3, and in general the main frame 3 is supported on the panel 1, a front glass of the cathode ray tube, by four plate springs 2(left, right, top and bottom). Other than supporting the main frame 3, as the plate spring 2 is required to attenuate external vibration, the plate spring 2 is designed thin so as to have a rigidity very smaller than the main frame 3. If a tension to the shadow mask 5 is not enough, the howling is occurred caused by external vibration. In this instance, even if the shadow mask 5 vibrates in up and down directions by the external impact, though the howling at a central portion of the shadow mask 5 is not distinctive as incident angles of the electron beams are not great at the central portion, the howling at a peripheral portion of the shadow mask 5 is significant as incident angles of the electron beams are great at the peripheral portion. Therefore, as shown in FIG. 3A, for preventing the howling in the related art, there are springs 3" fitted to left and right sides of sub-frames 3', and damper wires 9 are connected to the left and right side springs, for restricting vibration of the shadow mask. However, the damper wires 9 on the effective surface 7 of the shadow mask block the electron beams, to show dark shadow across the screen, and increases cost. As an alternative to the spring fastening, as shown in FIG. 3B, clips 10 are fitted to the left and right outer portions of the effective surface 7 of the shadow mask 5, for reducing an amplitude and a time period of the vibration by friction occurred between the shadow mask 5 and the clips 10. However, this case has not so great effect of vibration attenuation, and the fitting process and formation of the clips increases cost.

SUMMARY OF THE INVENTION

Accordingly, the present invention is directed to a structure for preventing howling of a shadow mask in a cathode ray tube that substantially obviates one or more of the problems due to limitations and disadvantages of the related art.

An object of the present invention is to provide a structure for preventing howling of a shadow mask in a cathode ray tube, which can improve howling caused by up and down vibration of a shadow mask even at side portions of the shadow mask.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the structure for preventing howling of a shadow mask in a cathode ray tube having a panel with a fluorescent material screen on an inside surface thereof, the shadow mask for selecting a color of electron beams emitted from an electron gun, and frames each fastened to a long side of the shadow mask to support the shadow mask on the panel through connecting means for applying a tension to the shadow mask in a vertical direction, wherein the shadow mask includes an effective surface having holes for selecting the color of the electron beams, non-effective surfaces which form no screen, and howling prevention members bent along short side edges of the non-effective surfaces in a horizontal front-to-back direction.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention:

In the drawings:

FIGS. 3A and 3B illustrate examples of related art devices for preventing howling of a shadow mask, wherein FIG. 3A illustrates damper wires strapped around an effective surface of the shadow mask, and FIG. 3B illustrates clips fitted to non-effective surfaces of the shadow mask.

FIGS. 5A and 5B illustrate perspective views of a structure for preventing howling of a shadow mask in accordance with a preferred embodiment of the present invention, wherein FIG. 5A illustrates a frontal perspective view of a shadow mask assembly, and FIG. 5B illustrates a back side perspective view of a shadow mask assembly, and FIGS. 6A and 6B illustrate vibration modes of the shadow masks of the related art and the present invention, wherein FIG. 6A illustrates a vibration mode of the shadow mask of the related art which has no device for preventing howling, and FIG. 6B illustrates a vibration mode of the shadow mask of the present invention having a device for preventing howling(bent portions).

DETAILED DESCRIPTION OF THE PREFERRED EMBODIMENT

Figure 1:
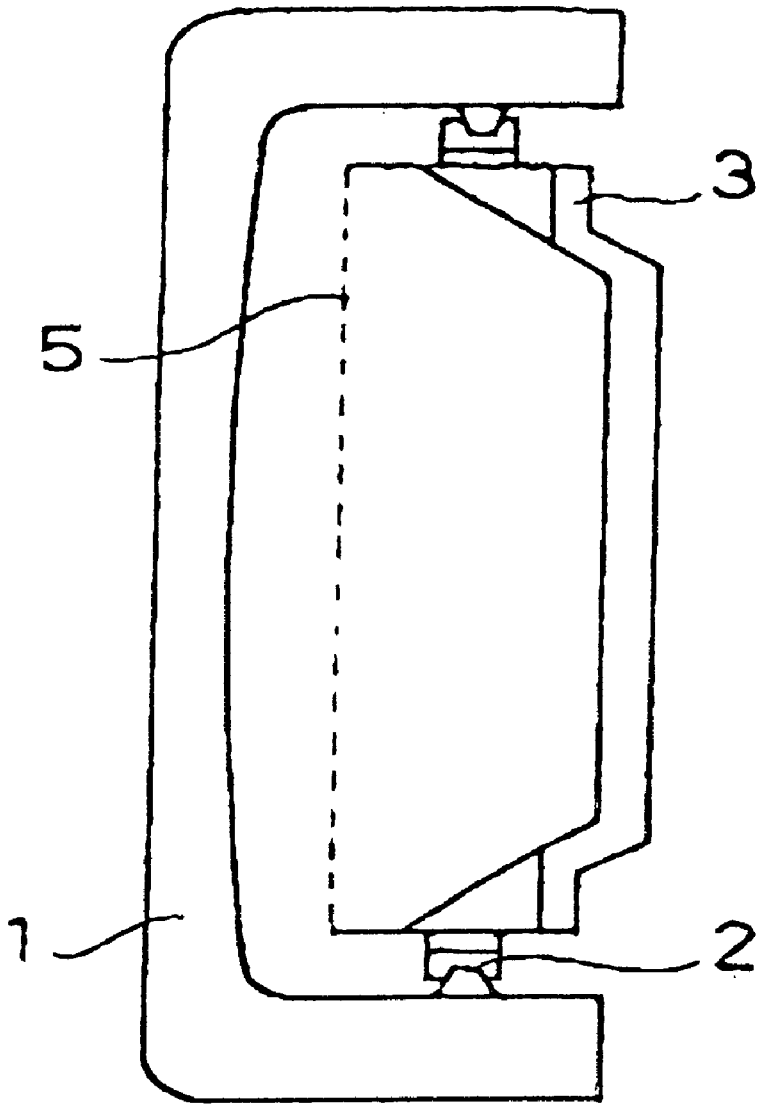
FIG.1 Prior Art
FIG. 1 illustrates a side section of a related art assembly of a panel and a shadow mask.
Figure 2:
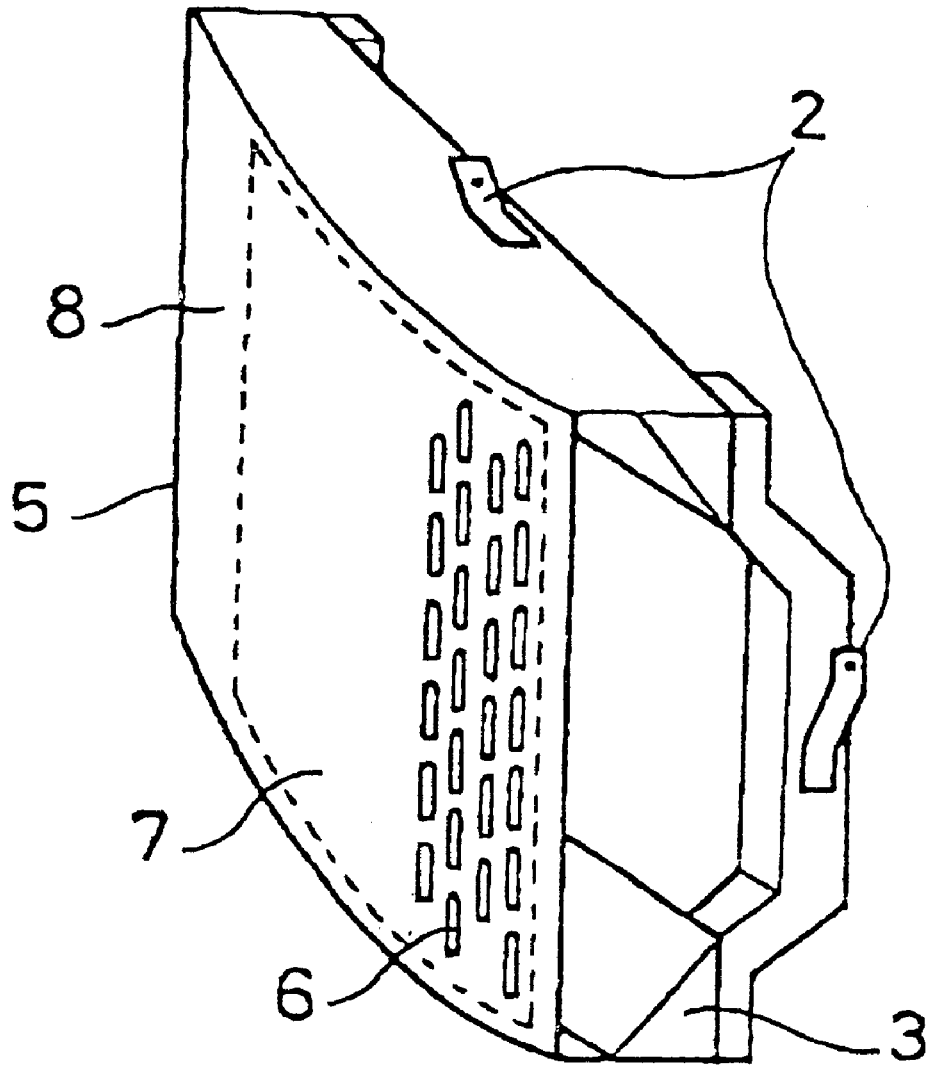
FIG.2 Prior Art
FIG. 2 illustrates a detailed perspective view of an outer appearance of the shadow mask in FIG. 1.
Figure 3:
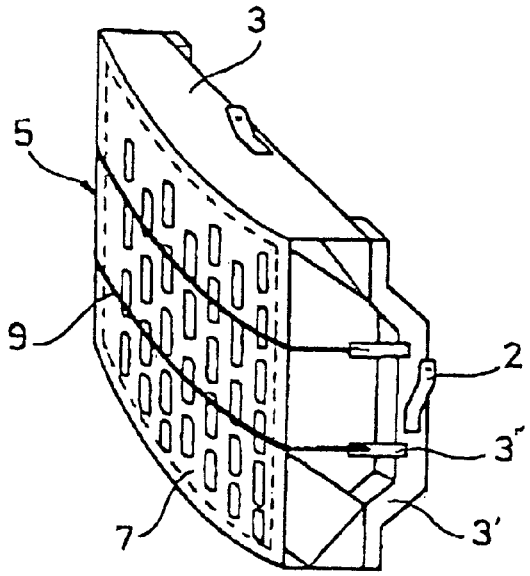
FIG. 3 Prior Art
Figure 3:
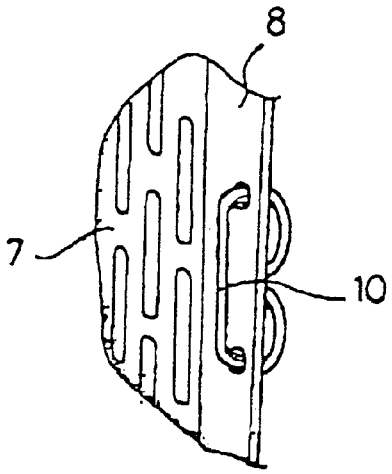
FIG. 3 Prior Art
Figure 4:
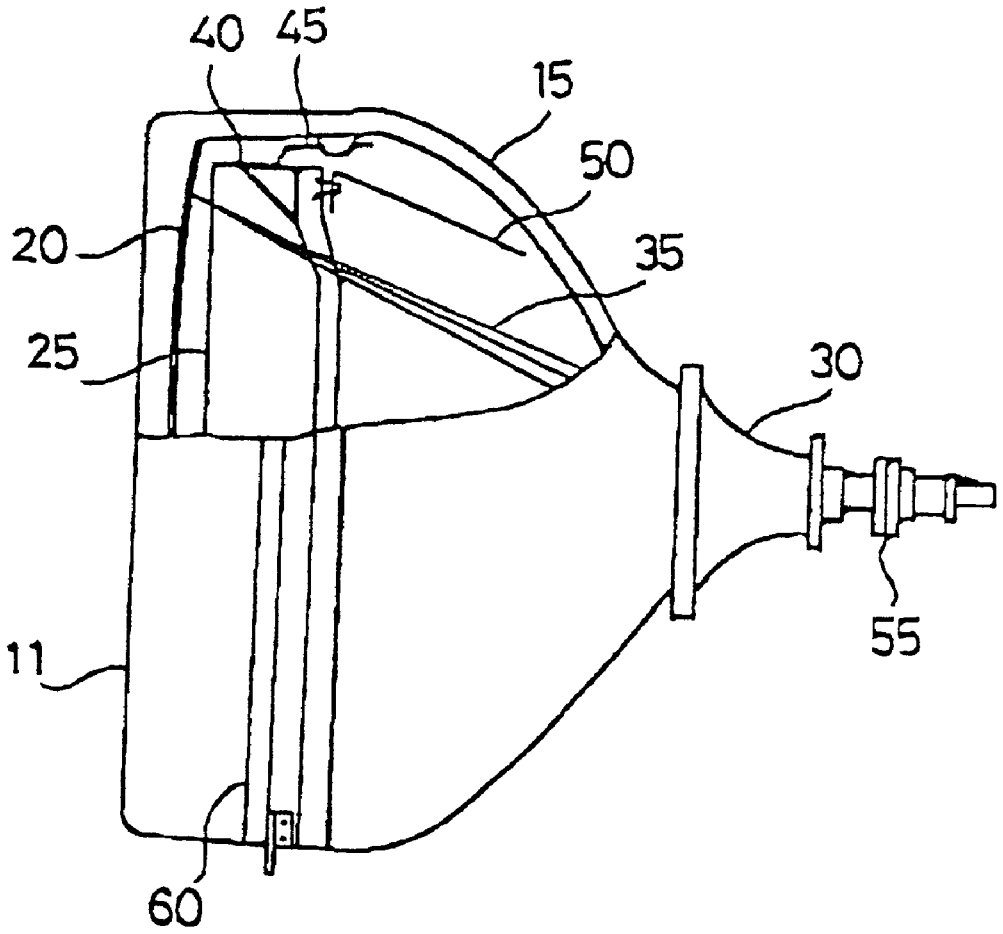
FIG 4 Prior Art
FIG. 4 illustrates a side view of a related art cathode ray tube with a partial cut away view.

Reference will now be made in detail to the preferred embodiments of the present invention, examples of which are illustrated in the accompanying drawings. FIG. 4 illustrates a side view of a related art cathode ray tube with a partial cut away view, inclusive of a panel 11, a funnel 15, a shadow mask 20, a fluorescent surface 25, a deflection yoke 30, a main frame 40, springs 45, an inner shield 50, magnets 55, and reinforcing bands 60. As an external voltage is applied to an anode, the foregoing cathode ray tube has electron beams 35 emitted from an electron gun built-in a neck portion of the funnel 15 to hit onto a particular fluorescent surface 20 on an inside surface of the panel 11, when the electron beams are deflected in an up, down, left, or right direction by the deflection yoke and pass through the hole 25 in the shadow mask 25 before the electron beams reach to the fluorescent surface 20. And, for exact hitting by the electron beams 35 onto the fluorescent surface 20, there are 2, 4, 6 polar magnets 55 for preventing deterioration of a color purity. For preventing burst collapse of the cathode ray tube by an external impact due to a high vacuum in the cathode ray tube, the panel 11 and the funnel 15 are designed to have a structure which can withstand high stress, and the reinforcing bands 60 are fitted to a skirt portion of the panel 11 for dispersing the stress to the cathode ray tube to the maximum, to secure an enough anti-impact capability.

Figure 5:
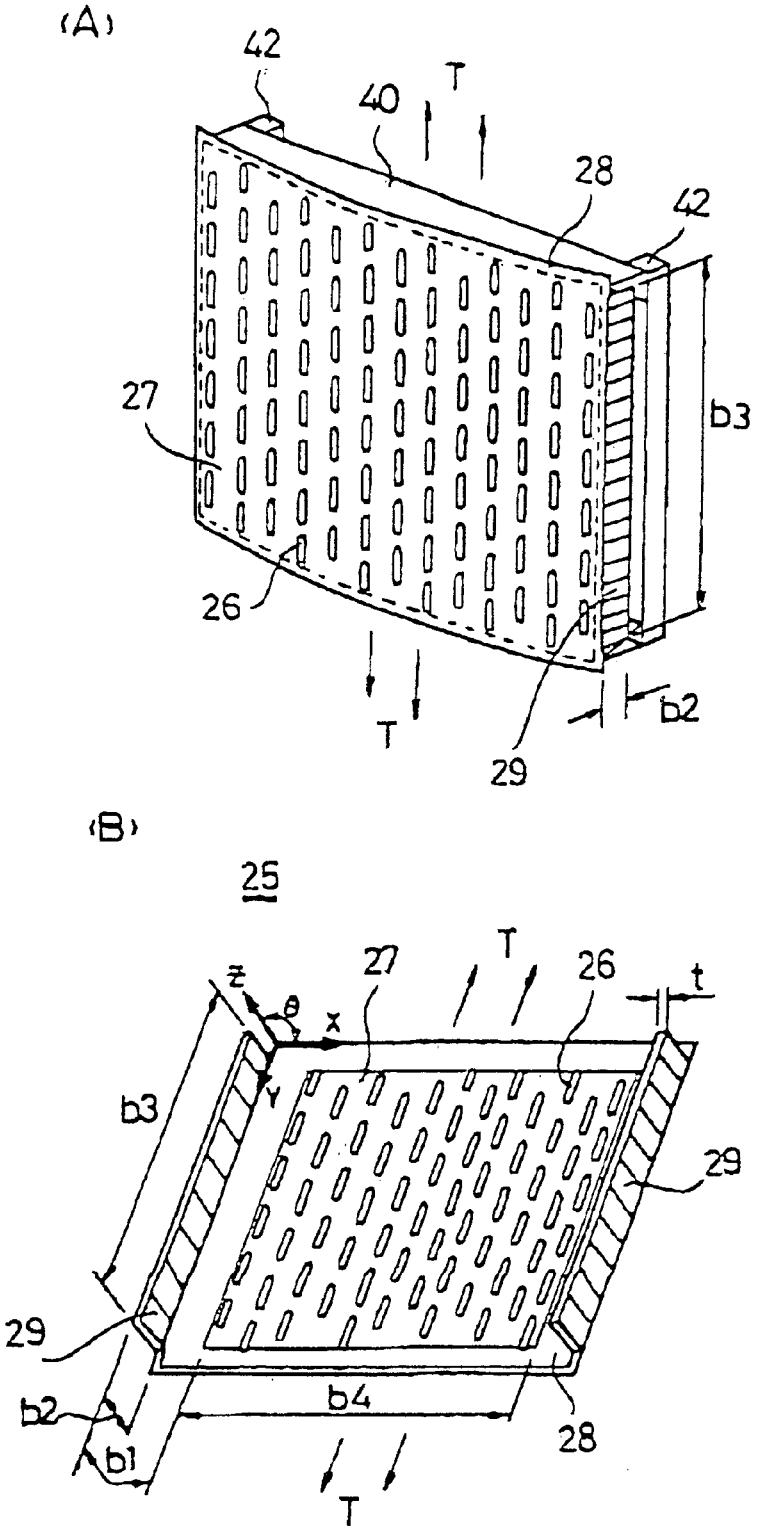

FIGS. 5A and 5B illustrate perspective views of a structure for preventing howling of a shadow mask in accordance with a preferred embodiment of the present invention, wherein FIG. 5A illustrates a frontal perspective view of a shadow mask assembly, and FIG. 5B illustrates a back side perspective view of a shadow mask assembly.

Referring to FIG. 5A, there is the main frame 40 fastened along long sides of the shadow mask 25 for supporting the shadow mask, and supplementary frames 42 fitted to the main frame 40, fitted to a top side and a bottom side of the shadow mask 25, in a vertical direction spaced from the shadow mask 25. The shadow mask 25 includes an effective surface 27 having a plurality of holes 26, non-effective surfaces 28 on the outer sides of the effective surface 27 having no holes 26, and bent parts 29, howling prevention members, each formed along an edge of a short side of each of the non-effective surfaces 28 in a Z-axis direction. As shown in the drawings, the bent parts 29, the howling prevention members, are thin and long plates each fitted along a short side of the non-effective surface 28 of the shadow mask 25 in a Z-axis direction at a fixed angle. As shown in FIG. 5B, in the shadow mask having an up and down vertical direction tension T as the main frame 40 is fastened thereto along top and bottom long side edges thereof, the bent parts extended in a horizontal front-to-back direction from the left and right side edges of the non-effective surfaces 28 enhances a rigidity of the short side portions of the non-effective surfaces, that improves the howling.

The natural frequency 'f' of the shadow mask may be expressed as follows.

$$f_1(\mathrm{Hz}) = \frac{\lambda_1^2}{2\pi L^2}\sqrt{\frac{EI_y}{\rho}}. \tag{1}$$

where, $\lambda$=4.73004074, f: natural frequency of the shadow mask,

E: modulus of elasticity,

I: moment of inertia, $\rho$: mass per unit length, and

L: length of the shadow mask.

$$I_y = \frac{1}{3}\times[t\cdot(B_2-Z)^3 + B_1\cdot Z^3 - B_3\cdot(Z-t)^3], \tag{2}$$

$$\text{where, } B_1 = b_1 + \frac{1}{2}t, \quad B_2 = b_2 + \frac{1}{2}t,$$

$$B_3 = b_1 - \frac{1}{2}t, \quad Z = \frac{B_2^2 + B_3 t}{2\cdot(b_1+b_2)},$$

$b_1$: a horizontal length of a non-effective surface extending in both the front-to-back and side-to-side directions, $b_2$: a horizontal front-to-back length of a bent part, $b_3$: a vertical length of an effective surface, $b_4$: A horizontal side-to-side length of an effective surface, t: a thickness of the bent part.

In general, for shadow masks of identical material, identical lengths, and identical modulus of elasticity, the greater the amount of inertia, the higher the natural frequency and rigidity. When the left and right non-effective surfaces are bent as shown in FIG. 5B for enhancing the moment of inertia 'I', the natural frequency 'f' of the shadow mask is increased. However, though the longer the horizontal front-to-back length $b_2$ of the bent part 29, a howling prevention member, the greater the X-axis moment of inertia 'I' and the higher the natural frequency 'f', a Y-axis moment of inertia I becomes the lower as can be known from the equation (2) below, there may be vibration occurred at the bent parts 29.

$$f_1 = \frac{1}{2\pi}\cdot\frac{\lambda_1}{b_2^2}\cdot\sqrt{\frac{D}{\rho}}, \tag{3}$$

where, $\lambda_1 = 3.52 - 0.0967\beta + 0.03\beta^2 - 4.76\times10^{-3}\beta^3$, $$\beta = \frac{b_2}{b_3},$$

-continued $$D = \frac{E \cdot t^3}{12(1 - \nu^2)},$$

ν: Poisson's ratio

An optimal horizontal front-to-back length $b_2$ of the bent part 29, at which the X-axis moment of inertia 'I' that gives a direct influence to the howling is great and the Y-axis moment of inertia 'I' of each of the bent parts is not small, can be derived from the equations (1) and (2). That is, in a case when the horizontal front-to-back length $b_2$ of the bent part 29 is below a 10% of a horizontal front-to-back and side-to-side length $b_1$ of the non-effective surface 28, the X-axis moment of inertia 'I' is not great enough to provide a satisfactory effect of natural frequency 'f' increase coming from the enhancement of the rigidity. Different from this, in a case when the horizontal front-to-back length $b_2$ of the bent part 29 is greater than a 60% of a horizontal front-to-back and side-to-side length $b_1$ of the non-effective surface 28, the Y-axis moment of inertia 'I' is small, such that the horizontal front-to-back length $b_2$ of the bent part 29 causes vibration. Accordingly, the horizontal front-to-back length $b_2$ of the bent part 29 should be set to be between 10%~60% of a horizontal front-to-back and side-to-side length $b_1$ of the non-effective surface 28, for obtaining a high effect of the natural frequency 'f' increase coming from the enhanced rigidity. As an angle of bending of the bent part 29 makes almost no difference to the moment of inertia, the bending is carried out only considering workability. By the way, though the bent parts 29, howling prevention members, are fastened to the shadow mask 25 along the short side edges of the non-effective surface 28, the non-effective surfaces 28 may be extended more in the short sides in fabrication of the shadow mask 25, to form the bent parts 29 as one unit with the shadow mask 25.

Figure 6:
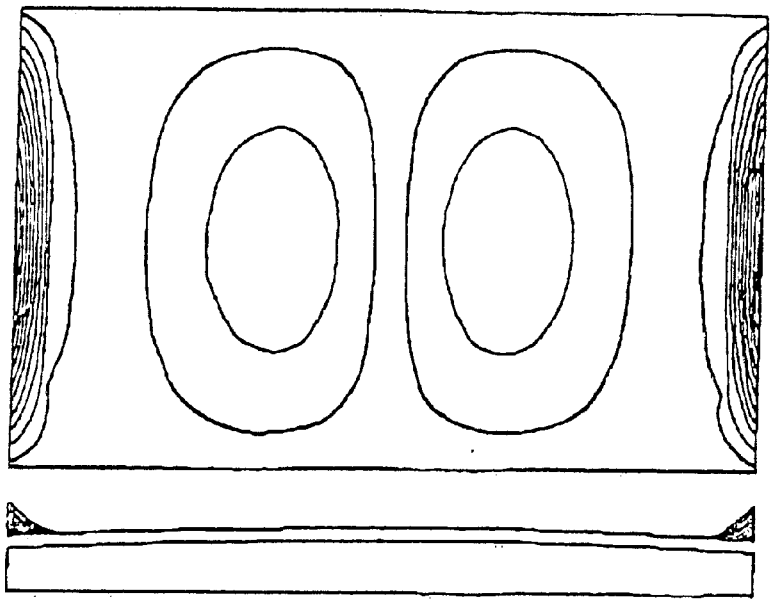
Figure 6:
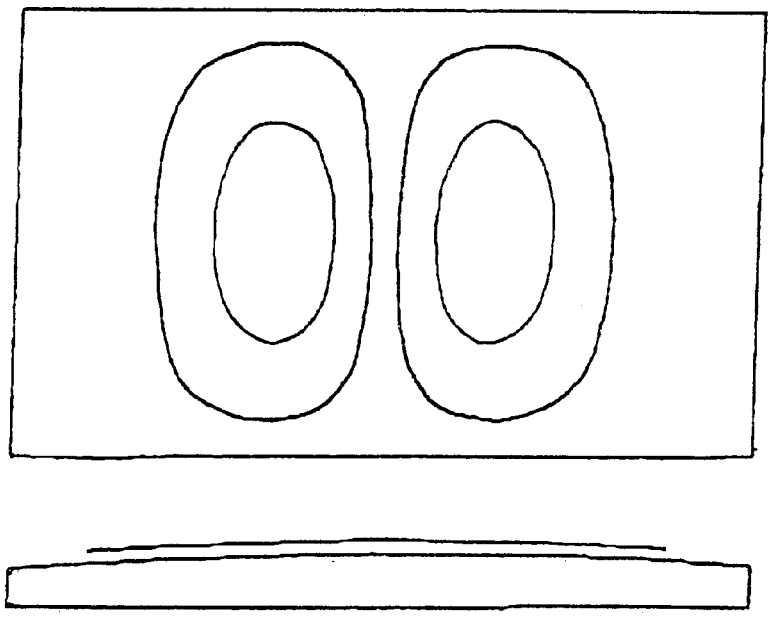

FIGS. 6A and 6B illustrate vibration modes of the shadow masks of the related art and the present invention, wherein FIG. 6A illustrates a vibration mode of the shadow mask of the related art which has no device for preventing howling, and FIG. 6B illustrates a vibration mode of the shadow mask of the present invention having a device for preventing howling.

Referring to FIG. 6A, in general since the shadow mask 5 is, not only a wide and thin plate, but also has a tension 'T' applied only in a vertical direction, vibration is liable to occur caused by an external disturbance at left and right portions of the non-effective surfaces 28. Therefore, if the main frame vibrates, the central portion of the shadow mask 5 fastened to the main frame shows a weak vibration, but the left, and right portions thereof vibrate strongly at a fixed frequency. However, as shown in FIG. 5B, if the bent parts 29, vibration prevention members, are formed along short sides of the non-effective surfaces 28 of the shadow mask 25, rigidities of the left and right edge portions of the non-effective surfaces 28 are enhanced, such that the natural frequencies 'f' of the left and right edge portions of the non-effective surfaces 28 become greater than the natural frequency of the shadow mask 25. According to this, as shown in FIG. 6B, even if there is vibration occurred at the shadow mask 25, the vibration of the shadow mask 25 and the vibration of the howling prevention members 29 are offset, to attenuate the vibrations because the howling prevention members have vibrations different from the shadow mask 25.

As has been explained, the structure for preventing howling of a shadow mask in a cathode ray tube of the present invention has the following advantage.

The bent parts extended from left and right edges of the shadow mask having a vertical tension applied thereto in a horizontal front-to-back direction provides a greater moment of inertia and natural frequency of edge portions of the shadow mask, that improves howling caused by up and down vibration at the edge portions of the shadow mask, thereby minimizing beam landing errors in which the electron beams can not properly pass through the holes in the edge portions of the shadow mask due to the vibration of the shadow mask caused by an external disturbance, and improving the howling.

It will be apparent to those skilled in the art that various modifications and variations can be made in the structure for preventing howling of a shadow mask in a cathode ray tube of the present invention without departing from the spirit or scope of the invention. Thus, it is intended that the present invention cover the modifications and variations of this invention provided they come within the scope of the appended claims and their equivalents.

What is claimed is:

1. A structure for preventing howling of a shadow mask in a cathode ray tube including a panel including a fluorescent material screen on an inside surface thereof, the shadow mask for selecting a color of electron beams emitted from an electron gun, and frames each fastened to a long side of the shadow mask to support the shadow mask on the panel through connecting means for applying a tension to the shadow mask in a vertical direction, wherein the shadow mask comprises:

an effective surface having holes for selecting the color of the electron beams;

non-effective surfaces which form no screen; and howling prevention members separate from said frames bent along short side edges of the non-effective surfaces in a horizontal front-to-back direction.

2. A structure as claimed in claim 1, wherein the howling prevention member has a horizontal front-to-back length $b_2$ defined to be $0.1 \times b_1 \leqq b_2 \leqq 0.6 b_1$, where the $b_1$ denotes a horizontal front-to-back and side-to-side length of the non-effective surface.

3. A structure as claimed in claim 1, wherein the howling prevention member is a bent form of a plate formed as one unit with the shadow mask, of the same material with the shadow mask.

4. A structure as claimed in claim 1, wherein the howling prevention member enhances a moment of inertia of the shadow mask and increases the natural frequency of the shadow mask.

5. The structure as claimed in claim 1, wherein the howling prevention members are plates.

* * * * *